US006037533A

United States Patent [19]

Runyon

[11] Patent Number: 6,037,533

[45] Date of Patent: Mar. 14, 2000

[54] SAXOPHONE THUMB REST AND OCTAVE KEY ATTACHMENTS

[76] Inventor: Clinton A. Runyon, 174 Emerite Dr., Lafayette, La. 70506

[21] Appl. No.: 09/307,584

[22] Filed: May 7, 1999

[51] Int. Cl.[7] ..... G10D 7/08

[52] U.S. Cl. ..... 84/385 R; 84/380 R; 84/453

[58] Field of Search ..... 84/385 R, 385 A, 84/382, 387 A, 453, 380 R

[56] References Cited

U.S. PATENT DOCUMENTS

| | | | |
|---|---|---|---|
| 4,148,242 | 4/1979 | Woehr et al. | 84/385 R |
| 5,949,007 | 9/1999 | Rumore | 84/380 R |

*Primary Examiner*—Bentsu Ro
*Assistant Examiner*—Shih-yung Hsieh
*Attorney, Agent, or Firm*—Robert N. Montgomery

[57] ABSTRACT

A set of attachments for securing to the thumb rest of a saxophone and its adjacent octave key which helps the beginning student and professional players alike to maintain a more natural and proper left hand placement relative to the instrument. The attachments include a polymeric, saddle shaped pad adapted to fit over the left hand thumb rest of the saxophone and a curved, polymeric pad attachable to the adjacent octave key, both attachments adhered to the instrument by an adhesive, the attachments maintaining proper alignment of the left thumb perpendicularly to the octave key and the left hand in a proper, relaxed playing and holding position, the curved octave key pad being of sufficient height and shape to allow a smooth, sliding transition, thus allowing the left thumb to depress the octave key without leaving the thumb rest or changing relative angle position.

9 Claims, 3 Drawing Sheets

SAXOPHONE THUMB REST AND OCTAVE KEY ATTACHMENTS

BACKGROUND OF THE INVENTION

1. Field of the Invention

This invention relates generally to key attachments for musical instruments and more particularly to attachments for thumb rest and adjacent octave key of a saxophone.

2. General Background

Several wind musical instruments have thumb rests which help the musician hold the instrument and further help position the hands in the correct position for playing the instrument. The left hand thumb rest of a saxophone is located slightly above the mid point of the instrument and is simply a post having a round, flat head portion for placing the left thumb. The musician's left thumb performs an additional function by depressing an adjacent octave key lever from time to time. This function requires the thumb to be rotated over the edge of the thumb rest in order to depress the octave key lever since the lever and the thumb rest are generally the same height to allow a smooth transition. Repeated depression of the octave key may cause soreness after long periods of play.

Since the saxophone thumb rest is round and the instrument is sometimes played without a strap, especially the soprano saxophone, the musician's hand tends to become horizontal relative to the instrument and therefore departing from the proper position whereby the thumb is perpendicular to the octave lever. Although this improper positioning of the thumb does not necessarily affect the operation of the octave lever, it does affect the positioning of the fingers of the left hand relative to the instrument keys. Therefore, with improper finger positions, the fingering of keys becomes sloppy and awkward to manage. It is essential that the left hand, when holding the instrument, remain in a natural wrist position which places the thumb at approximately a 30 degree angle off the vertical, thereby properly positioning the fingers and placing the thumb perpendicular to the octave key. This problem, although subtle, is overcome by accomplished players but is a significant problem for beginners who tend to form bad habits without knowing why.

There is a need to correct the above problem to insure proper thump placement on the thumb rest and further to improve transition from the rest to octave key in such a way as to allow the thumb to remain in the proper position and not be required to arch over the edge of the rest.

SUMMARY OF THE INVENTION

The instant invention provides attachments for securing to the thumb rest of a saxophone and its adjacent octave key which help the beginning student and professional players alike to maintain a more natural and proper left hand placement relative to the instrument. The attachments include a polymeric, saddle shaped pad adapted to fit over the thumb rest of the saxophone and a curved polymeric, pad attachable to the adjacent octave key. The attachments are secured to the thumb rest and octave key with a super adhesive. The saddle maintains alignment of the left thumb perpendicularly to the octave key and the curved octave key pad is of sufficient height and shape to allow a smooth transition while allowing the left thumb to depress the octave key without leaving the left thumb rest or changing relative position. The octave key pad riser further allows octave lever depression by the left thumb above the horizontal instead of below the horizontal.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
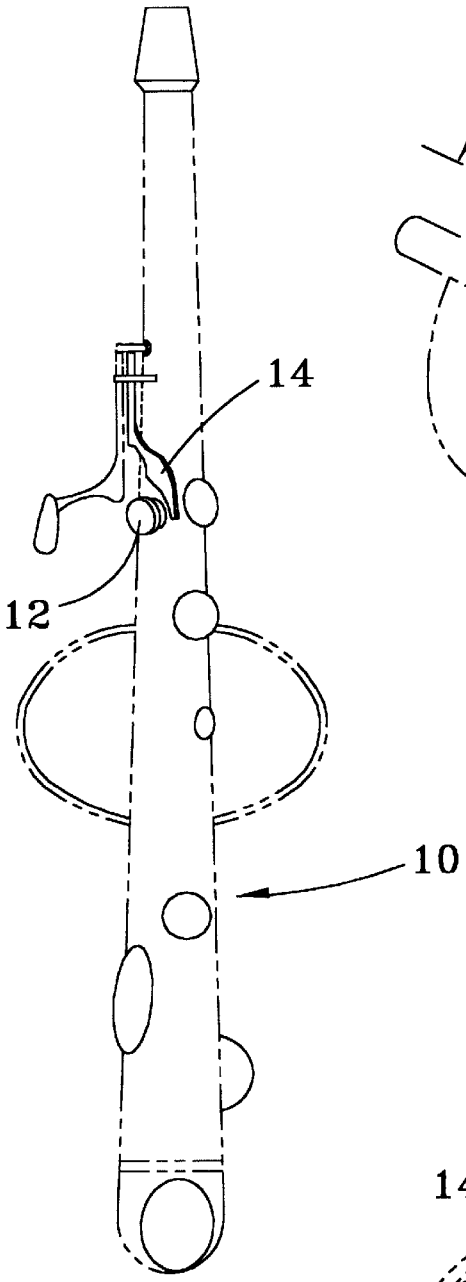
FIG. 1 Prior Art
FIG. 1 is a partial illustration of the rear view of a saxophone illustrating the instrument's left thumb rest and adjacent octave lever.
Figure 2:
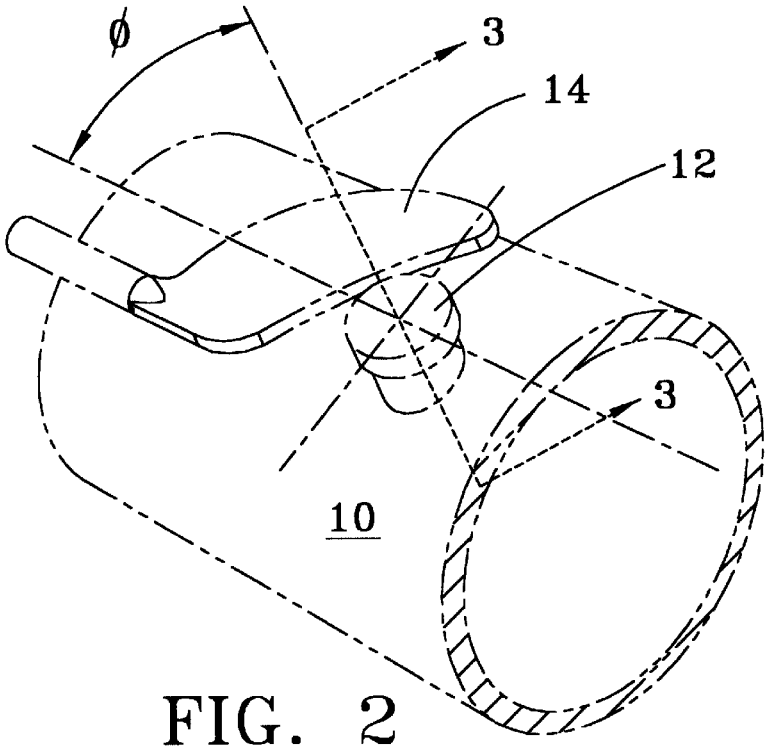
FIG. 2 Prior Art
FIG. 2 is a partial, close up, isometric view of the left thumb rest and octave lever illustrated in FIG. 1.
Figure 3:
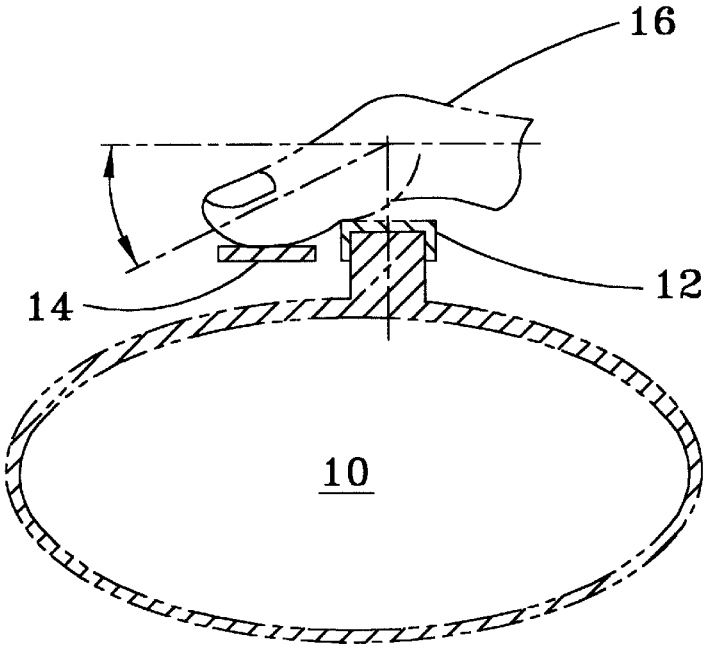
FIG. 3 Prior Art
FIG. 3 is a cross section view taken along sight line 3—3 seen in FIG. 2 illustrating the prior art.

The saxophone, or instrument, 10 left thumb rest 12 and adjacent octave lever 14 are illustrated in FIG. 1 and in close up in FIG. 2. Operation of the octave key 14 is normally accomplished by depressing the octave lever 14 with the left hand thumb 16 which is normally positioned on the thumb rest 12 as seen in FIG. 3. To accomplish this, the thumb 16 must be rotated over the edge of the thumb rest 12, thereby causing irritation and misalignment of the thumb 16 relative to the instrument 10. Proper alignment of the left hand dictates that the thumb 16 should be perpendicular to the octave key lever 14 and at an angle Ø of between 30 and 45 degrees off the vertical. This positions the left hand in a natural position relative to the finger keys as well. The more horizontal the thumb 16 becomes relative to the thumb rest 12, the more out of place the fingers of the left hand become. As seen in FIG. 3, the thumb 16 must rotate over the edge of the rest 12 to depress the octave lever, thereby causing the thumb to rotate below the horizontal and causing the hand to be contorted, thus causing fatigue.

Figure 4:
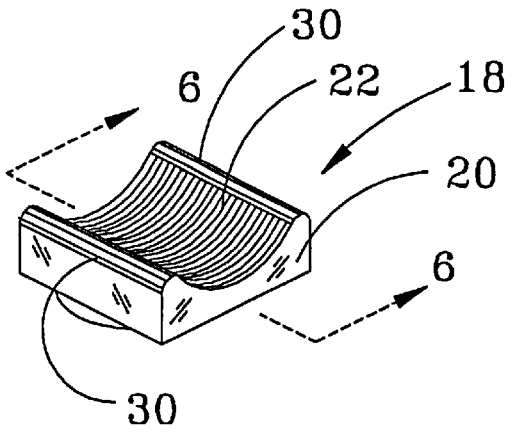
FIG. 4 is an isometric view of the left thumb rest pad.
Figure 5:
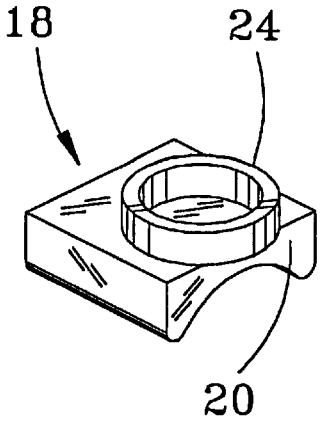
FIG. 5 is a bottom view of the pad illustrated in FIG. 4.
Figure 6:
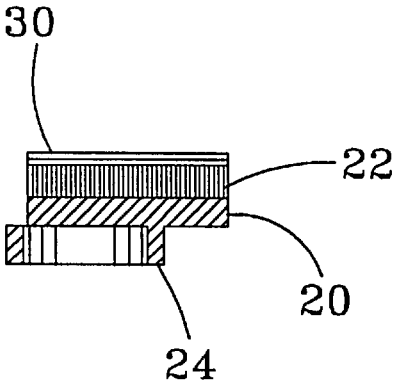
FIG. 6 is a cross section view of the pad taken along sight line 6—6 seen in FIG. 4.

In order to reduce fatigue while supporting the instrument 10 and depressing the octave key lever 14, a polymeric pad 18, as seen in FIG. 4, has been developed which fits over the thumb rest 12. The pad 18 includes a concave body portion having grooves 22 therein and a raised ring portion 24, seen in FIG. 5, the ring portion 24 having a diameter coinciding with the thumb rest 12. The ring portion 24 of the pad 18 is offset towards one end, as seen in cross section in FIG. 6, to prevent any interference with the octave lever.

Figure 7:
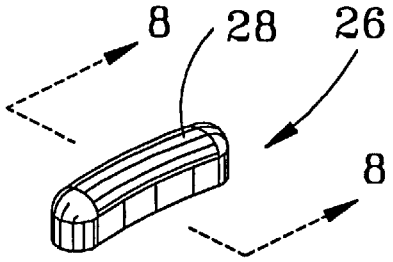
FIG. 7 is an isometric view of the octave lever pad.
Figure 8:
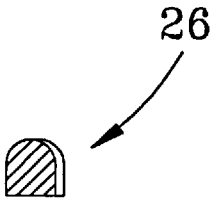
FIG. 8 is a cross section view of the octave lever pad taken along sight line 8—8 seen in FIG. 7.
Figure 11:
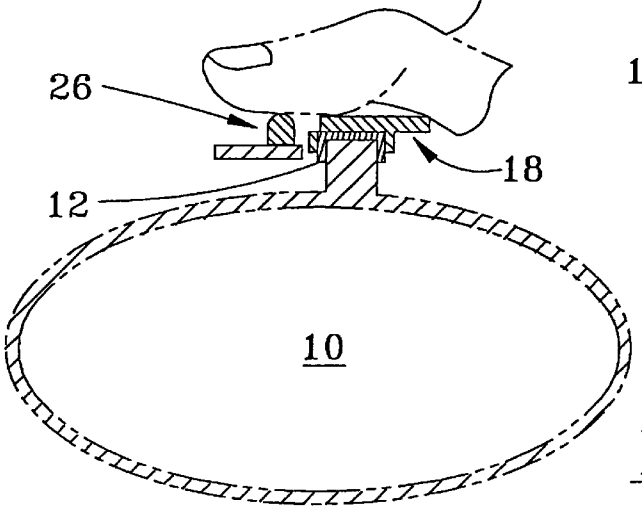
FIG. 11 is a cross section view of the assembled attachments illustrated in FIGS. 4 and 7 with octave lever depressed.

An elongated, curved, polymeric pad is also provided, as seen in FIG. 7 and in cross section in FIG. 8, for attachment to the octave key lever 14. The octave key lever pad 26 in effect raises the height of the lever 14 to the height of the thumb rest pad 18 This lever pad 26 is smooth and rounded on the upper surfaces 28 to allow for a smooth transition by the thumb 16 from the rest pad 18 to the lever pad 26. By raising the height of the lever to the height of the upper edges 30 of the rest pad, seen in FIGS. 4 and 6, the lever pad 26 is above the lowest point of curved surface of the thumb rest, as seen in FIG. 11.

Figure 9:
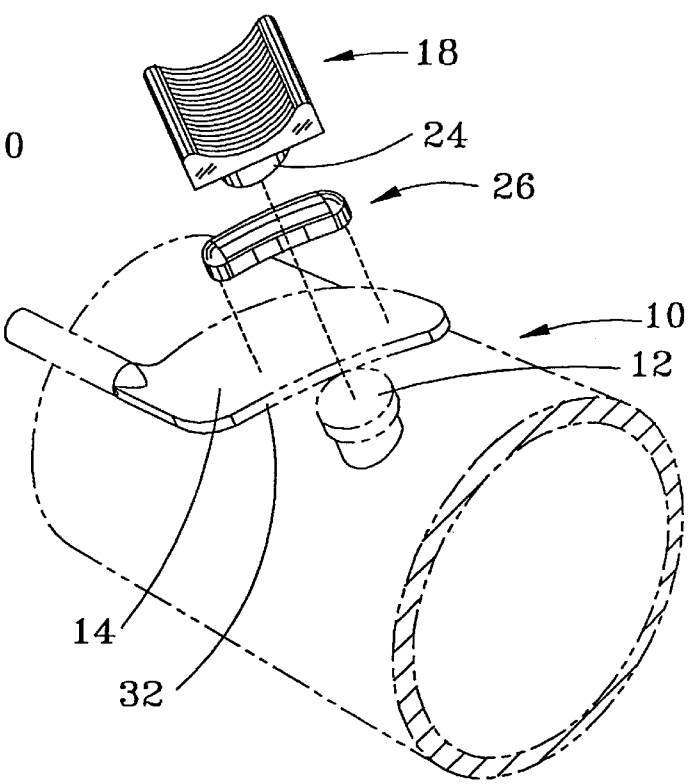
FIG. 9 is an isometric, partial, cross sectional exploded view illustrating location of the attachments shown in FIGS. 4 and 7 relative to octave lever and left thumb rest illustrated in FIG. 2.
Figure 10:
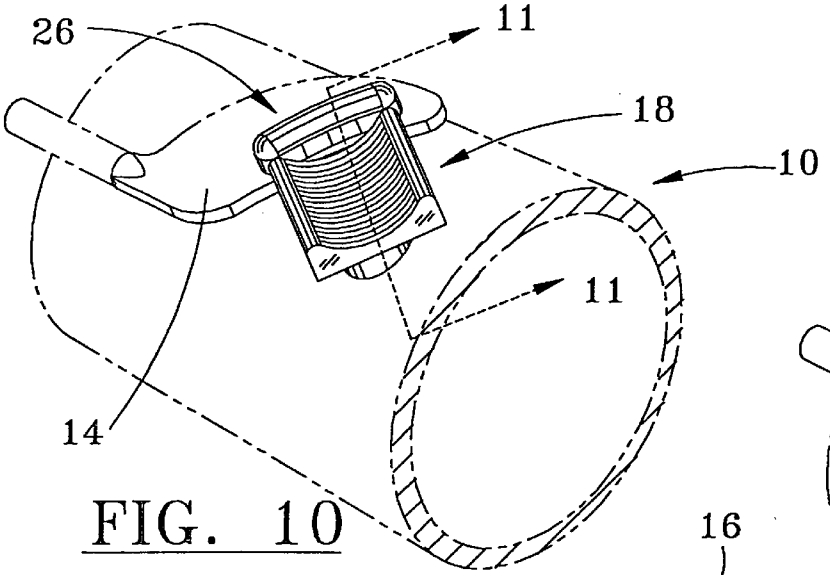
FIG. 10 is an isometric, partial cross section assembly view of the attachments illustrated in FIGS. 4 and 7.

As seen in FIG. 9, the rest pad 18 and lever pad 26 are positioned in a manner whereby the rest pad's 18 ring portion 24 is placed over the instrument's thumb rest 12 at an angle perpendicular to the octave key lever 14 and at an angle of between 30 and 45 degrees off the vertical. The lever pad 26 is adhered to the octave key lever with its curved side parallel to the lever's leading edge 32. The attachments may be adhered to the instrument 10 in a number of ways, preferably with a strong adhesive. The assembly, as seen in FIG. 10, places the attachments 18, 26 in adjacent alignment, thus providing easy transition by the thumb 16 from the rest pad 18 to the lever pad 26 without rotating over the edge of the thumb rest. As seen in FIG. 11, the thumb now simply slides along the concave surface of the thumb rest 18 to engage and thus depress the lever pad 26.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A set of thumb rest and octave lever attachments for a saxophone, said set of attachments comprising:

a) a polymeric thumb rest attachment adaptable to a saxophone thumb rest; and b) an attachment means for elevating the height of a saxophone's octave key lever to that of the polymeric thumb rest attachment.

2. The set of thumb rest and octave lever attachments according to claim 1 wherein the thumb rest attachment is a polymeric component having an elongated concave surface with ridges thereon and a raised ring portion located on a surface opposite said concave surface.

3. The set of thumb rest and octave lever attachments according to claim 2 wherein said ring portion is offset towards one end of the thumb rest attachment.

4. The set of thumb rest and octave lever attachments according to claim 1 wherein the attachment means for extending the height of a saxophone's adjacent octave key lever is an elongated, arcuate, polymeric component having a height approximating the height of the thumb rest attachment.

5. The set of thumb rest and octave lever attachments according to claim 4 wherein the attachment means for extending has one flat surface for attaching to the octave lever.

6. A method for improving left hand thumb movement and hand positioning relative to a saxophone comprising the steps of:

a) providing a set of attachments comprising:

i) an elongated, polymeric thumb rest attachment having a concave surface along its longitudinal center line and a raised ring portion extending from a surface opposite the concave surface suitably adaptable to encircle a saxophone thumb rest; and ii) an attachment means for elevating the height of a saxophone's octave key lever to that of the polymeric thumb rest attachment;

b) adhering the ring portion of the thumb rest attachment to a saxophone's left hand thumb rest in a manner wherein the thumb rest longitudinal center line is positioned perpendicular to the octave key lever located adjacent the saxophone thumb rest;

c) adhering the attachment means for elevating the height of a saxophone's octave key lever to the octave key lever whereby the attachment means for elevating is perpendicular, in close proximity to, and in alignment with said thumb rest attachment.

7. The method for improving left hand thumb movement and hand positioning relative to a saxophone according to claim 6 further comprising the step of aligning the longitudinal center line of the thumb rest attachment to between 30–45 degrees from the vertical relative to the saxophone's longitudinal center line.

8. The method for improving left hand thumb movement and hand positioning relative to a saxophone according to claim 6 further comprising the step of positioning the means for elevating in a manner wherein depression of the means for elevating is accomplished by the sliding of a saxophone player's left thumb linearly along the concave surface of the thumb rest attachment into contact with the means for elevating.

9. A method of maintaining proper left hand and finger positioning for playing a saxophone comprising the step of providing an elongated polymeric attachment having a concave surface with ridges therein adhered to the saxophone's left hand thumb rest and adhering an elongated, arcuate polymeric attachment to the octave key lever perpendicularly to and in close proximity to the thumb rest attachment, thereby elevating the height of the saxophone's octave key lever to the height of the thumb rest attachment and positioning the thumb rest and octave key lever attachments in a manner which helps position a saxophone player's left thumb and hand in proper posture for holding and playing the saxophone and, thereby, providing for an easier and more positive depression of the octave key lever without changing thumb angle position.

* * * * *